US010736389B2

(12) United States Patent
Bourban et al.

(10) Patent No.: US 10,736,389 B2
(45) Date of Patent: Aug. 11, 2020

(54) METHOD FOR SETTING A STONE

(71) Applicant: The Swatch Group Research and Development Ltd, Marin (CH)

(72) Inventors: Stewes Bourban, Chabrey (CH); Pascal Grossenbacher, Neuchatel (CH); Jean-Claude Martin, Montmollin (CH); Vladislav Spassov, Praz (CH); Cecile Barron, Corcelles (CH); Lionel Blaser, Corcelles (CH); Yann Caloz, Pampigny (CH); Cyrille Gernez, Boudry (CH); Stephane Lauper, Cortaillod (CH); Ahmad Odeh, Renens (CH); Simon Springer, Bern (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/141,370

(22) Filed: Sep. 25, 2018

(65) Prior Publication Data

US 2019/0133271 A1 May 9, 2019

(30) Foreign Application Priority Data

Nov. 7, 2017 (EP) ..... 17200365

(51) Int. Cl.
*G04B 47/04* (2006.01)
*A44C 17/04* (2006.01)
(Continued)

(52) U.S. Cl.
CPC ..... *A44C 17/04* (2013.01); *A44C 27/00* (2013.01); *C25D 1/003* (2013.01); *C25D 5/022* (2013.01); *C25D 7/005* (2013.01); *G04B 47/042* (2013.01)

(58) Field of Classification Search
CPC ..... A44C 17/04; A44C 27/00; G04B 47/042; C25D 5/022; C25D 1/003; C25D 7/005
See application file for complete search history.

(56) References Cited

U.S. PATENT DOCUMENTS

RE20,193 E * 12/1936 Swarovski ..... A44C 17/04 63/33
4,936,116 A * 6/1990 Poll ..... A44C 17/04 428/347

(Continued)

FOREIGN PATENT DOCUMENTS

EP 0 620 987 A1 10/1994
FR 2 717 051 A1 9/1995

OTHER PUBLICATIONS

European Search Report dated Mar. 9, 2018 in European application 17200365.9, filed on Nov. 7, 2017 (with English Translation of categories cited).

*Primary Examiner* — Rick K Chang
(74) *Attorney, Agent, or Firm* — Oblon, McClelland, Maier & Neustadt, L.L.P.

(57) ABSTRACT

A method for assembling a stone on to a mounting includes sinking the stone into an adhesive layer on a substrate and then positioning a setting sheet around the stone above the adhesive layer so as to form a peripheral free space between the setting sheet and the stone, at least at the level of the girdle and of areas of the crown and the pavilion adjacent to the girdle. Then, a metallic layer is deposited in the peripheral free space from the setting sheet, at least at the level of the girdle and of the areas of the crown and the pavilion adjacent to the girdle, such that the metallic layer and the setting sheet form the mounting.

14 Claims, 1 Drawing Sheet

(51) Int. Cl.

| | |
|---|---|
| ***C25D 7/00*** | (2006.01) |
| ***C25D 5/02*** | (2006.01) |
| ***C25D 1/00*** | (2006.01) |
| ***A44C 27/00*** | (2006.01) |

(56) References Cited

U.S. PATENT DOCUMENTS 5,177,984 A * 1/1993 Arata ..... A44C 17/04 63/26
5,338,591 A * 8/1994 Poll ..... A44C 17/04 428/67
5,432,988 A * 7/1995 Woo ..... A44C 17/04 29/10
5,548,976 A * 8/1996 Slowinski ..... A44C 17/04 63/28
5,560,224 A * 10/1996 Tessler ..... A44C 17/04 63/28
6,125,516 A * 10/2000 Winkler ..... A44C 17/04 29/10
6,212,745 B1 * 4/2001 Pierre ..... A44C 17/04 205/114
6,253,432 B1 * 7/2001 Peters ..... A44C 17/04 29/10
6,293,129 B1 * 9/2001 Gurevich ..... A44C 17/005 63/26
6,318,121 B1 * 11/2001 Pachauer ..... A44C 17/04 63/26
6,491,424 B1 * 12/2002 Tardy ..... G04B 39/00 368/283
6,499,314 B1 * 12/2002 Weinmann ..... A44C 17/0216 63/26
6,668,584 B1 * 12/2003 Tosti ..... A44C 17/02 63/26
7,140,199 B2 * 11/2006 Behr ..... A44C 17/04 63/27
7,596,967 B2 * 10/2009 Ostfeld ..... A44C 17/04 63/26
7,691,221 B2 * 4/2010 Swarovski ..... A44C 17/04 156/250
7,971,326 B2 * 7/2011 Apprederisse ..... A44C 17/04 29/10
8,215,126 B2 * 7/2012 Mattar ..... A44C 17/005 63/26
8,789,251 B2 * 7/2014 Labow ..... A44C 17/02 29/10
9,084,457 B2 * 7/2015 Rizzo ..... A44C 17/02
9,204,693 B2 * 12/2015 Sunne ..... A44C 17/02
9,345,294 B2 * 5/2016 Grossenbacher .... A44C 17/005
9,462,859 B2 * 10/2016 Disinger ..... A44C 15/0015
9,820,538 B2 * 11/2017 Lebreton ..... G04B 47/042

* cited by examiner

METHOD FOR SETTING A STONE

This application claims priority from European patent application No. 17200365.9 filed on Nov. 7, 2017, the entire disclosure of which is hereby incorporated herein by reference.

TECHNICAL FIELD

The invention relates to a method for assembling a stone on to a mounting, said stone being cut so that it has a table, a crown, a girdle and a pavilion. The invention also relates to a method for setting a stone and its mounting, produced by said assembly method, on an element of a timepiece or a of a piece of jewelry.

TECHNICAL BACKGROUND

There are known methods of setting precious, semi-precious or synthetic stones using claws, beads or rails. Conventional setting by mounting a natural stone in a bezel using claws usually requires a dimensional accuracy of about 5/100 in the stone cutting. This type of setting is therefore incompatible with serially produced, low cost stone setting, where stones such as synthetic diamond, zircon and ruby, cut with a higher precision of about 1/100, are used.

BRIEF DESCRIPTION OF THE INVENTION

The object of the present invention is to overcome this drawback by proposing a method of setting stones which makes it possible to disregard the inevitable dimensional variations found when natural stones such as diamonds are used.

For this purpose, the invention relates, in the first place, to a method for assembling a stone on to a mounting, said stone being cut so that it has a table, a crown, a girdle and a pavilion, said method comprising the following steps:

a) providing a substrate comprising a hot-melt adhesive layer;
b) positioning the stone on the hot-melt adhesive layer of the substrate;
c) heating the hot-melt adhesive layer;
d) exerting a pressure on the stone so that part of the crown or part of the pavilion of the stone can be sunk into the sufficiently softened hot-melt adhesive layer, leaving the rest of the stone, that is to say either the rest of the crown, the girdle and the pavilion, or the rest of the pavilion, the girdle and the crown, respectively, exposed;
e) positioning a setting sheet around the stone above the adhesive layer, so as to form a peripheral free space between the setting sheet and said stone, at least at the level of the girdle and of areas of the crown and the pavilion adjacent to the girdle;
f) depositing a metallic layer in said peripheral free space by galvanic growth from the setting sheet, at least at the level of the girdle and of the areas of the crown and the pavilion adjacent to the girdle, so as to trap said girdle in said metallic layer, the metallic layer and the setting sheet forming said mounting;
g) releasing said stone and its mounting from the substrate.

The positioning of the stones using the hot-melt adhesive layer according to the method of the invention makes it unnecessary to create housings of adequate size in advance to receive the stones. The method according to the invention therefore allows the dimensional variations of the stones to be disregarded.

The invention also relates to a method for setting a stone on an element of a timepiece or a of a piece of jewelry, comprising fitting the stone and its mounting, produced according to the method defined above, on to a bezel which is then affixed to the element of the timepiece or piece of jewelry, or directly on to the element of the timepiece or piece of jewelry.

The invention also relates to an element of a timepiece or a of a piece of jewelry, comprising at least one stone assembled on to its mounting, produced according to the assembly method as defined above.

BRIEF DESCRIPTION OF THE DRAWINGS

Other characteristics and advantages will be clearly apparent from the description given below, for illustrative purposes and in an entirely non-limiting way, with reference to the attached drawings, of which.

DETAILED DESCRIPTION OF PREFERRED EMBODIMENTS

Figure 1:
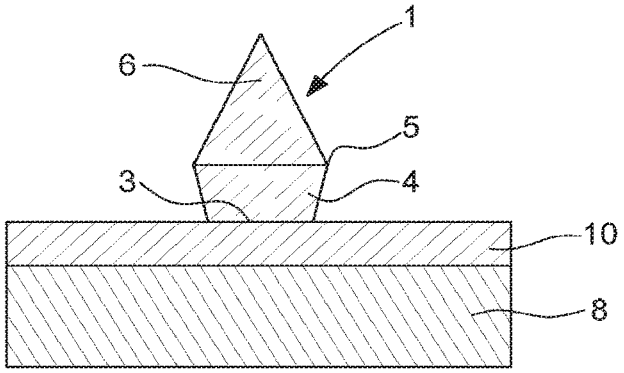
FIGS. 1 to 5 are representations of the successive steps of a method for assembling a stone on to a mounting according to the invention.

With reference to FIGS. 1 to 5, the present invention relates to a method for assembling a stone 1 on to a mounting 2, said stone 1 being cut so that it has a table 3, a crown 4, a girdle 5 and a pavilion 6. Such a stone is preferably a stone of natural origin such as diamond or emerald, the dimensions of which may vary from one stone to another. Evidently, the stone may be of any other kind, whether natural or synthetic, the method according to the invention being usable in an equally advantageous way for such stones.

The first step a) of the method for assembling the stone 1 on to a mounting 2 according to the invention consists in providing a substrate 8 comprising a hot-melt adhesive layer 10.

Preferably, the substrate 8 takes the form of a plate, and is based on glass, ceramic, polymer, metal, silicon, quartz or any other appropriate support with a flat surface. Advantageously, the substrate 8 is a glass plate.

The hot-melt adhesive layer 10 is preferably a layer of adhesive soluble in hot water or a solvent, of the hot-melt type, such as Crystalbond™ or Wafer-Mount™ adhesive or any other similar appropriate mounting product.

The second step b) of the method for assembling the stone 1 on to a mounting 2 according to the invention consists in positioning the stone 1 on the hot-melt adhesive layer 10 of the substrate 8. In an advantageous and particularly preferable way, the stone 1 is positioned so that its table 3 is in contact with the adhesive layer 10, as shown in FIG. 1. A number of stones may be positioned in this way on the substrate. The positioning of the stones may correspond to the desired final shape, for example a specific pattern.

The third step c) of the assembly method of the invention consists in heating the hot-melt adhesive layer 10 so that it is at least sufficiently softened to enable the stones 1 to be sunk into it.

Figure 2:
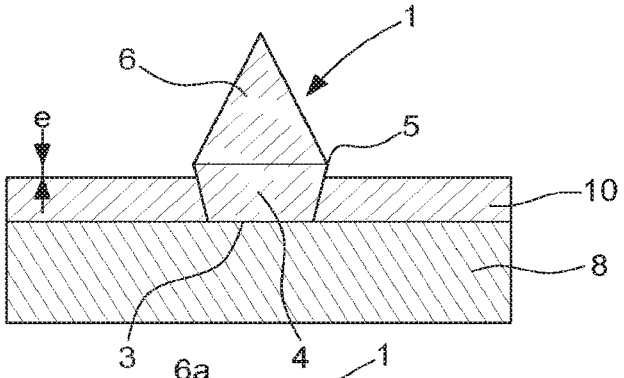

The fourth step d) of the assembly method of the invention consists in exerting a pressure on the stone 1 so that, according to the variant shown here, only a part of the crown 4 of the stone 1 can be sunk into the sufficiently softened hot-melt adhesive layer 10, so that the rest of the crown 4, the girdle 5 and the pavilion 6 remain exposed, as shown in FIG. 2. Advantageously, the stone 1 is sunk until its table 3 comes into contact with the substrate 8, thus ensuring that the table 3 is flat.

Evidently, the order of steps b) and c) may be reversed. Step b) may advantageously be executed after step c), notably if the stone 1 is positioned so that it is its pavilion 6 that is partially sunk into the sufficiently softened hot-melt adhesive layer, leaving the rest of the stone exposed, so that the rest of the pavilion 6, the girdle 5 and the crown 4 remain exposed.

The depth of the hot-melt adhesive layer 10 is chosen so that the crown 4 (or the pavilion 6, depending on the variant used) is practically entirely sunk into the hot-melt adhesive layer 10, and comes into contact with the substrate 8, only a part of the crown 4 (or of the pavilion 6) having a small thickness e (see FIG. 2) being left exposed under the girdle 5. This part will comprise the area 4*a* of the crown 4 (or the area 6*a* of the pavilion 6) adjacent to the girdle 5, as these are defined below.

The resulting assembly is left to cool so that the adhesive layer 10 solidifies and holds the stone 1 on the substrate 8 without the need to form suitable housings in said substrate.

The use of the method of the invention then continues according to step e), with the positioning of a setting sheet 12 above the adhesive layer 10 (which is cooled and solidified), the sheet being cut around the stone 1 so as to form a peripheral free space 16 between the portion 14 of the setting sheet 12 and said stone 1, at least at the level of the girdle 5 and of an area 4*a* of the crown 4 and an area 6*b* of the pavilion 6, said areas 4*a* and 6*a* being adjacent to the girdle 5.

The setting sheet 12 is made of a conductive material, for example a metallic material chosen from the group comprising nickel, gold, silver, platinum, palladium, copper, brass, and their alloys. Thus the peripheral free space 16 is delimited by the conductive surface of the portion 14 of the setting sheet 12.

Figure 3:
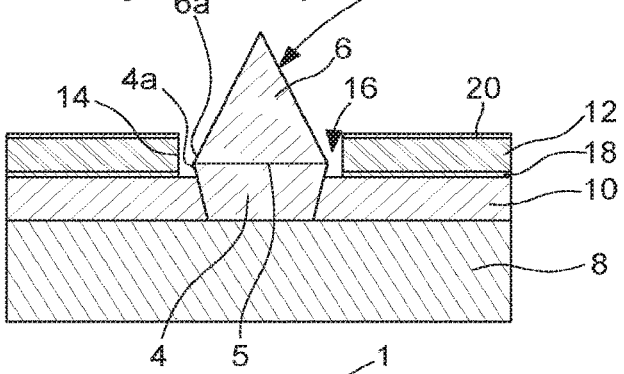

Step e) also comprises the placing of a lower insulating layer 18 between the adhesive layer 10 and the setting sheet 12 and the placing of an upper insulating layer 20 on the free surface of the setting sheet 12, as shown in FIG. 3. The insulating layers 18 and 20 are cut out around the stone and are sandwiched with the setting sheet 12. They may take the form, for example, of sheets of organic material, such as polymers, resins, lacquers, or the like, or are produced, for example, by PVD (Physical Vapour Deposition), ALD (Atomic Layer Deposition), CVD (Chemical Layer Deposition) or other similar methods of deposition of thin dielectric layers of $SiO_2$, $Al_2O_3$, $TiO_2$, AlN, $Si_3N_4$, or the like.

Figure 4:
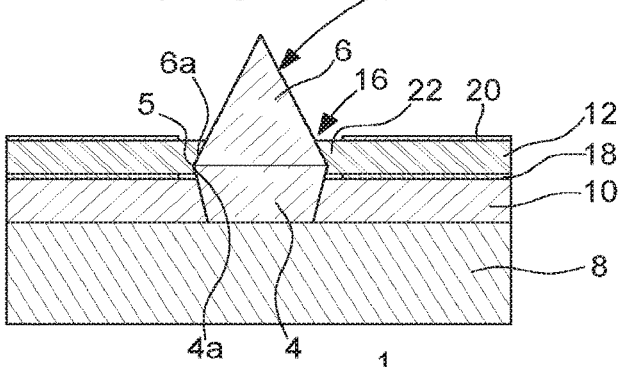

Next, step f) of the method of the invention consists in depositing a metallic layer 22 by galvanic growth in said peripheral free space 16 from the portion 14 of the setting sheet 12, at least at the level of the girdle 5 and of the areas 4*a* and 6*a* of the crown 4 and the pavilion 6 respectively adjacent to the girdle 5, so as to trap said girdle 5 in said metallic layer 22, as shown in FIG. 4. Since its girdle 5 is trapped in the metallic layer 22, the stone 1 is now integral with the setting sheet 12, the metallic layer 22 in the continuity of the setting sheet 12 forming said mounting 2 in combination with the sheet.

Preferably, the area 6*a* of the pavilion 6 adjacent to the girdle 5 and the area 4*a* of the crown 4 adjacent to the girdle 5 extend immediately on either side of the girdle 5 only, over a thickness smaller than the thickness e of the part of the crown left exposed, so as to form said metallic layer 22 between the stone 1 and the setting sheet, substantially around the girdle only, that is to say at the level of the girdle 5 and immediately on either side of said girdle 5 only.

The metallic layer 22 is preferably made of a material chosen from the group comprising nickel, gold, silver, platinum, rhodium, palladium, copper, and their alloys.

The electroforming conditions, notably the bath composition, the geometry of the system, the voltages and current densities, are chosen for each metal or alloy to be electrodeposited according to techniques which are well-known in the art of electroforming (see, for example, Di Bari G. A., "Electroforming", Electroplating Engineering Handbook 4th Edition, edited by L. J. Durney, published by Van Nostrand Reinhold Compagny Inc., N.Y. USA 1984).

The next step g) consists in releasing the stone 1, assembled on to its mounting 2, from the substrate 8. This step g) is carried out, for example, by dissolving the hot-melt adhesive layer 10 in an organic solvent. The insulating layers are removed by mechanical peeling, dissolving in organic solvents, or erosion (etching) by chemical agents.

Figure 5:
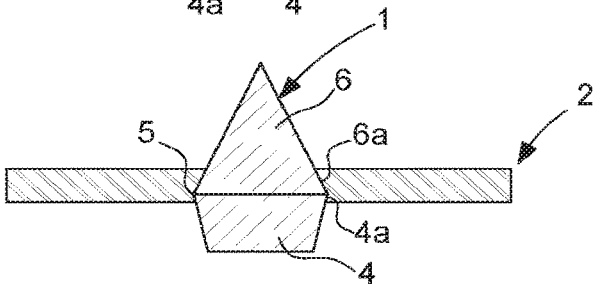

The result is a stone 1, assembled on to its mounting 2, as shown in FIG. 5.

When a plurality of stones 1 have been positioned on the hot-melt adhesive layer 10 in step b), the result is a mounting in the form of a plate comprising a plurality of stones 1 assembled on to said plate, the stones possibly forming a pattern.

Evidently, the dimensions of the mounting 2 are defined by the dimensions of the setting sheet 12. Notably, the thickness of the setting sheet 12 is preferably chosen so that the metallic layer 22 is deposited only substantially at the level of the girdle 5 and of the areas 4*a*, 6*a* respectively of the crown 4 and the pavilion 6 which extend only immediately on either side of the girdle 5 as described above, so that the mounting 2 is positioned substantially around the girdle 5 only, as shown in FIG. 5. The mounting 2 extends slightly over the areas 4*a* and 6*a* respectively of the crown 4 and the pavilion 6 adjacent to the girdle 5, but most of the crown 4 and the pavilion 6 remains free.

The assembly method according to the invention allows adaptation to the dimensional variations of the stones 1 by allowing the stones to be assembled on to their mounting without the need to form different housings in advance with appropriate dimensions for receiving the stones.

When released in this way, the stone 1 assembled on its mounting 2 may be used in the setting method according to the invention.

Said method for setting said stone on an element of a timepiece or a of a piece of jewelry comprises fitting the stone 1 and its mounting 2, produced according to the assembly method defined above, on to a bezel. The bezel is then attached to the element of the timepiece or of the piece of jewelry.

In another variant, the stone 1 and its mounting 2, produced according to the assembly method as described above, are fitted directly on the element of a timepiece or of a piece of jewelry.

The mounting 2, bearing the stone 1 on the bezel or directly on the element of a timepiece or of a piece of jewelry, may be fitted by clipping, pressing, setting, or other methods.

The element of a timepiece or of a piece of jewelry may be, for example, a dial, a bezel, a rotating bezel, a case middle, a horn of the case, a crown, a hand, a pointer, a link or other bracelet element, an element of a pendant, of a ring, of a necklace, or the like, any internal or external lining element, or any decorative element of a timepiece or of a piece of jewelry that can be set.

What is claimed is:

1. A method for assembling a stone on to a mounting, said stone being cut so that it has a table, a crown, a girdle and a pavilion, the method comprising the following steps:

a) providing a substrate comprising a hot-melt adhesive layer;

b) positioning the stone on the hot-melt adhesive layer of the substrate;

c) heating the hot-melt adhesive layer;

d) exerting a pressure on the stone so that only part of the crown or only part of the pavilion of the stone is sunk into the hot-melt adhesive;

e) positioning a setting sheet around the stone above the adhesive layer, so as to form a peripheral free space between the setting sheet and said stone, at least at a level of the girdle and of areas of the crown and the pavilion adjacent to the girdle;

f) depositing a metallic layer by galvanic growth in said peripheral free space from the setting sheet, at least at the level of the girdle and of the areas of the crown and the pavilion adjacent to the girdle, so as to trap said girdle in said metallic layer, the metallic layer and the setting sheet forming said mounting;

g) releasing said stone and the mounting from the substrate.

2. The method according to claim 1, wherein the area of the pavilion adjacent to the girdle and the area of the crown adjacent to the girdle extend immediately on either side of the girdle only, so that said metallic layer is formed between the stone and the setting sheet, substantially around the girdle only.

3. The method according to claim 1, wherein the setting sheet is made of a metallic material chosen from the group consisting of nickel, gold, silver, platinum, palladium, copper, brass, and their alloys.

4. The method according to claim 1, wherein step e) also comprises placing of a lower insulating layer between the adhesive layer and the setting sheet and placing of an upper insulating layer on a free surface of the setting sheet.

5. The method according to claim 4, wherein the lower insulating layer and the upper insulating layer are sheets of organic material.

6. The method according to claim 5, wherein the organic material is polymer, resin, or lacquer.

7. The method according to claim 1, wherein the metallic layer deposited in step f) is made of a material chosen from the group consisting of nickel, gold, silver, platinum, rhodium, palladium, copper, and their alloys.

8. The method according to claim 1, wherein the substrate is based on a material chosen from the group consisting of a glass, a ceramic, a silicon, a metal, a polymer and a quartz.

9. The method according to claim 1, wherein the hot-melt adhesive layer is a layer of soluble adhesive.

10. The method according to claim 1, wherein the release step g) is carried out by dissolving the hot-melt adhesive layer.

11. The method according to claim 1, wherein a plurality of stones are positioned on the hot-melt adhesive layer to form a mounting in the form of a plate comprising a plurality of stones assembled on to said plate.

12. The method according to claim 1, wherein the positioning the stone on the hot-melt adhesive layer of the substrate includes positioning the table of the stone in contact with the adhesive.

13. The method according to claim 1, wherein the exerting the pressure on the stone includes sinking the stone until the table contacts the substrate.

14. A method for setting a stone on an element of a timepiece or of a piece of jewellery, comprising:

assembling a stone on to a mounting, said stone being cut so that it has a table, a crown, a girdle and a pavilion, the assembling including providing a substrate comprising a hot-melt adhesive layer, positioning the stone on the hot-melt adhesive layer of the substrate, heating the hot-melt adhesive layer, exerting a pressure on the stone so that only part of the crown or only part of the pavilion of the stone is sunk into the hot-melt adhesive layer, positioning a setting sheet around the stone above the adhesive layer, so as to form a peripheral free space between the setting sheet and said stone, at least at a level of the girdle and of areas of the crown and the pavilion adjacent to the girdle, depositing a metallic layer by galvanic growth in said peripheral free space from the setting sheet, at least at the level of the girdle and of the areas of the crown and the pavilion adjacent to the girdle, so as to trap said girdle in said metallic layer, the metallic layer and the setting sheet forming said mounting, and releasing said stone and its mounting from the substrate; and fitting the stone and the mounting on to a bezel which is then affixed to the element of the timepiece or piece of jewellery, or directly on to the element of the timepiece or piece of jewellery.

* * * * *